United States Patent [19]

Puckett et al.

[11] 4,426,286

[45] Jan. 17, 1984

[54] SKIMMER

[75] Inventors: Joe D. Puckett, Benton; Donald L. Bryant, Bryant, both of Ark.

[73] Assignee: Jacuzzi Inc., Little Rock, Ark.

[21] Appl. No.: 331,270

[22] Filed: Dec. 16, 1981

[51] Int. Cl.[3] ..... E04H 3/20

[52] U.S. Cl. ..... 210/121; 210/169; 210/238

[58] Field of Search ..... 210/121, 122, 129, 169, 210/242.1, 238

[56] References Cited

U.S. PATENT DOCUMENTS

| | | | |
|---|---|---|---|
| 2,348,281 | 9/1952 | Perry | 210/129 |
| 2,701,235 | 2/1955 | King | 210/11 |
| 2,826,307 | 3/1958 | Pace | 210/169 |
| 2,844,255 | 7/1958 | Cavenah et al. | 210/170 |
| 2,900,079 | 8/1959 | Pace | 210/169 |
| 2,961,098 | 11/1960 | Nash | 210/241 |
| 2,980,256 | 4/1961 | Nash | 210/169 |
| 3,000,508 | 9/1961 | Spaulding et al. | 210/477 |
| 3,067,879 | 12/1962 | Baker | 210/129 |
| 3,314,543 | 4/1967 | Nash | 210/169 |
| 3,428,178 | 2/1969 | Nash | 210/121 |
| 3,508,661 | 4/1970 | Diemond et al. | 210/169 |
| 3,567,020 | 3/1971 | Whitaker et al. | 210/94 |
| 3,706,379 | 12/1972 | Erlich | 210/169 |
| 4,126,925 | 11/1978 | Jacuzzi | 29/428 |
| 4,212,740 | 7/1980 | Greene | 210/169 |

OTHER PUBLICATIONS

Jacuzzi pamphlet entitled "Wide Mouth Skimmer" (publication date unknown).

*Primary Examiner*—John Adee

*Attorney, Agent, or Firm*—Hill, Van Santen, Steadman & Simpson

[57] ABSTRACT

A skimming device which is arranged to be positioned within the wall of a receptacle for a body of water such as a swimming pool or spa, the device including a housing which has a horizontal inlet portion with an opening therein arranged to be positioned in open communication with the body of water, the housing having a downwardly extending vertical discharge chamber having an inlet which is of lesser cross-sectional area than the inlet of the horizontal inlet portion, a strainer basket proportioned to be received through the opening in the horizontal inlet and constructed and arranged to be snap-in seated in the vertical discharge portion, with a float pivotally secured to the strainer basket to substantially cover the basket when in a closed first position and also proportioned to be received through the opening, the float dimensions being larger than the opening to the vertical discharge chamber, the arrangement being such that the basket and the float are removable as a unit through the horizontal inlet portion of the housing.

22 Claims, 5 Drawing Figures

SKIMMER

BACKGROUND OF THE INVENTION

1. Field of the Invention

This invention is in the field of skimming devices for enclosed water bodies such as swimming pools or spas and includes a novel combination of a float which functions as a weir and a foraminous strainer basket pivotally connected to the float, the float and basket being positionable in operative relation through the front of the housing, and withdrawable without the necessity of tools.

2. Description of the Prior Art

Skimming devices are frequently incorporated into enclosures or receptacles for bodies of water such as swimming pools and spas for the purpose of facilitating removal of floating debris. In general, such skimmers include a weir device which is located inside the skimmer to create a movement of water across the pool or spa. The weir causes a differential water level which results in a positive skimming action across the surface of the pool, and a strainer basket is employed to collect debris before it can pass through to the pump system.

Previous installations, however, have generally required that the skimmer unit be partially disassembled to remove the basket for cleaning or replacement. Generally, this meant loosening a locking screw on the top of the unit and lifting the strainer basket out through the top.

SUMMARY OF THE INVENTION

The present invention provides an improved skimming device which is arranged to be received in tight-fitting engagement within a wall of an enclosure for a body of water. It includes a housing which is preferably composed of an inert synthetic resin material of one-piece construction insertable into an opening in a wall which can have raw or unfinished edges. The housing defines a horizontal inlet chamber having an opening therein which is arranged to be positioned in open communication with the body of water. The housing further has a downwardly extending vertical discharge chamber whose entrance opening is of lesser cross-sectional area than the opening to the horizontal inlet chamber. A strainer or foraminous strainer basket is proportioned to be received through the opening in the horizontal inlet chamber and is arranged to be seated in the vertical discharge chamber. A flange about the basket provides a self-seating capacity to hold the basket properly oriented with respect to the vertical discharge chamber. Spaced below the flange on opposite sides are tabs affording snap-in cooperation with adjoining lugs in the housing walls, thereby to retain the basket against flotational displacement.

A float which acts as a weir is pivotally secured to the strainer basket and is also proportioned to be received through the opening in the horizontal inlet chamber. The float fits only in the horizontal inlet chamber and is too large to be caught in the vertical discharge portion. the strainer basket and the float are pivotally secured to each other as by providing pins on the end portion of the float which are received in apertures carried by ears extending from the peripheral flange about the strainer basket. Thus, the basket is snapped into seated relation in the vertical discharge opening while the weir is floating in the horizontal inlet chamber. The float has an enlarged hollow portion toward the rear thereof which increases the buoyancy thereof. Consequently, the floating weir passes a thin sheet of water which provides a skimming action on the water with which the weir comes in contact. The float also forms a cover for the basket so the removal of the weir and basket simultaneously is facilitated by this arrangement, requiring no tools to accomplish the same and the risk of spilling the accumulated trash back into the water is minimized.

BRIEF DESCRIPTION OF THE DRAWINGS

A further description of the present invention will be made in conjunction with the attached sheets of drawings in which.

DESCRIPTION OF THE PREFERRED EMBODIMENTS

Figure 1:
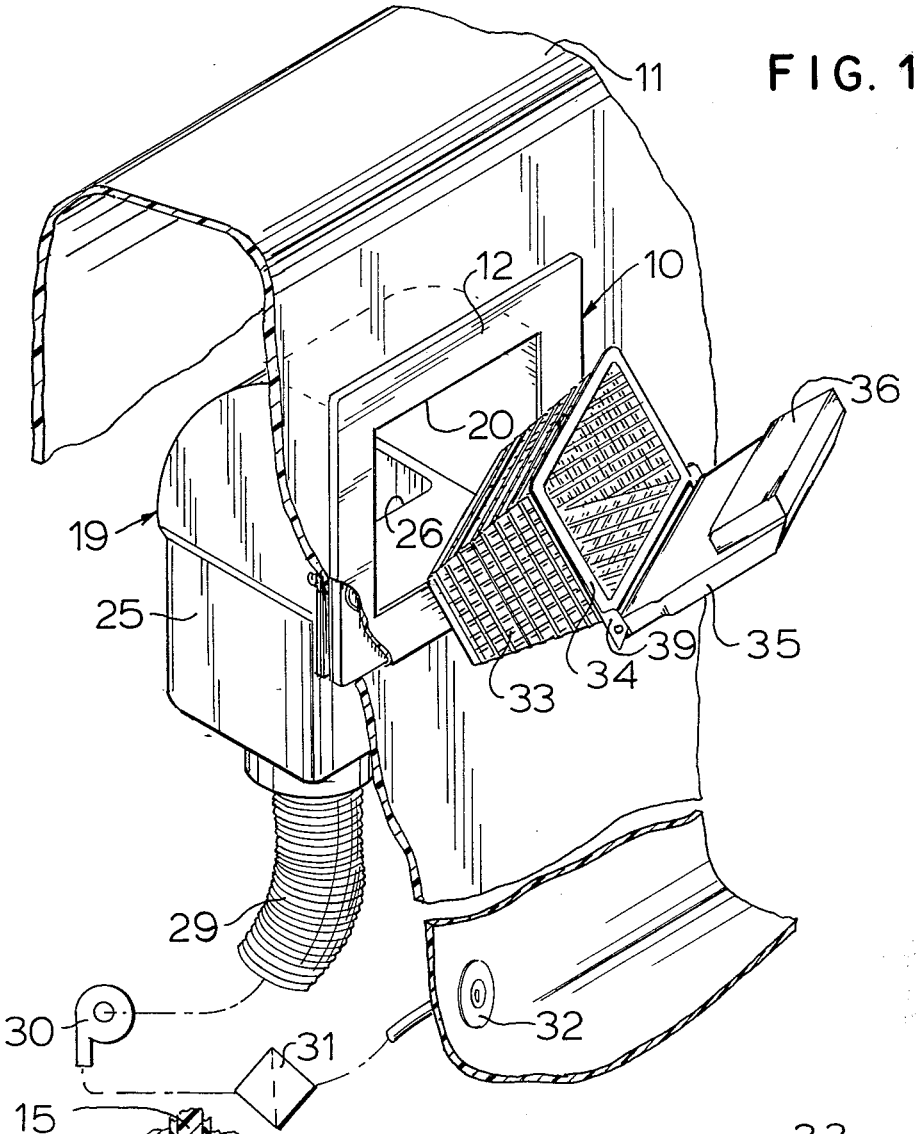
FIG. 1 is a view in perspective, partly exploded, illustrating the skimmer assembly of the present invention and in particular the manner in which the float and basket assemblies are removed.

As shown in FIG. 1, reference numeral 10 has been applied generally to an improved skimming device of the present invention, which in the illustrated form is received in tightly fitting engagement within a shell of a spa, swimming pool, or other enclosed body of water. The skimming device includes a front flange 12 behind which there is a mounting flange 13 (FIG. 3), and a gasket 14. Optionally, a rear-mounting flange 11, and a second gasket 16 may be provided. It should be understood that the skimmer of the present invention could be connected directly to a tub wall. Bolts 17 or screws may be used to hold the mounting flanges against the wall of the enclosure 15 by means of nuts 18 in the type of connection shown in the drawing.

One of the features of the present invention is that the skimmer housing is an integral unit opening through the sidewall of a receptacle, whether it be a pool, tub or spa, and the opening need not be specifically sized to a fine tolerance. On the contrary the wall opening may be a so-called raw opening O which is unfinished. The front flange overlies the edges of the opening O thereby concealing any unfinished rough surfaces.

The housing for the skimmer assembly is generally indicated at reference numeral 19. It is composed of an inert synthetic resin such as polyvinyl chloride, polyethylene, polypropylene, or the like, and is in the form of a one-piece construction. At the forward end of the housing 19 there is an opening 20 which communicates directly with the body of water in the enclosure. The opening 20 leads to a horizontal inlet chamber 21 which is defined by a horizontally extending base wall 22 and a rounded rear wall 23 of the housing. The horizontal inlet chamber 21 terminates into a downwardly extending vertical discharge chamber 24 defined by sidewalls 25 and having an inlet opening 26 as seen in FIG. 1. The inlet opening 26 is of lesser cross-sectional area than the inlet 20 leading to the horizontal inlet chamber 21. A discharge plate 27 is adhesively secured to the sidewalls 25 and provides a circular discharge neck 28 about which a discharge conduit 29 is received, which may be rigid or flexible as a matter of choice. Water circulated through the skimming unit is withdrawn through the conduit 29, passes through a pump 30, a filter 31 (if necessary), and then through a nozzle 32 to be recirculated into the main body of water.

Figure 3:
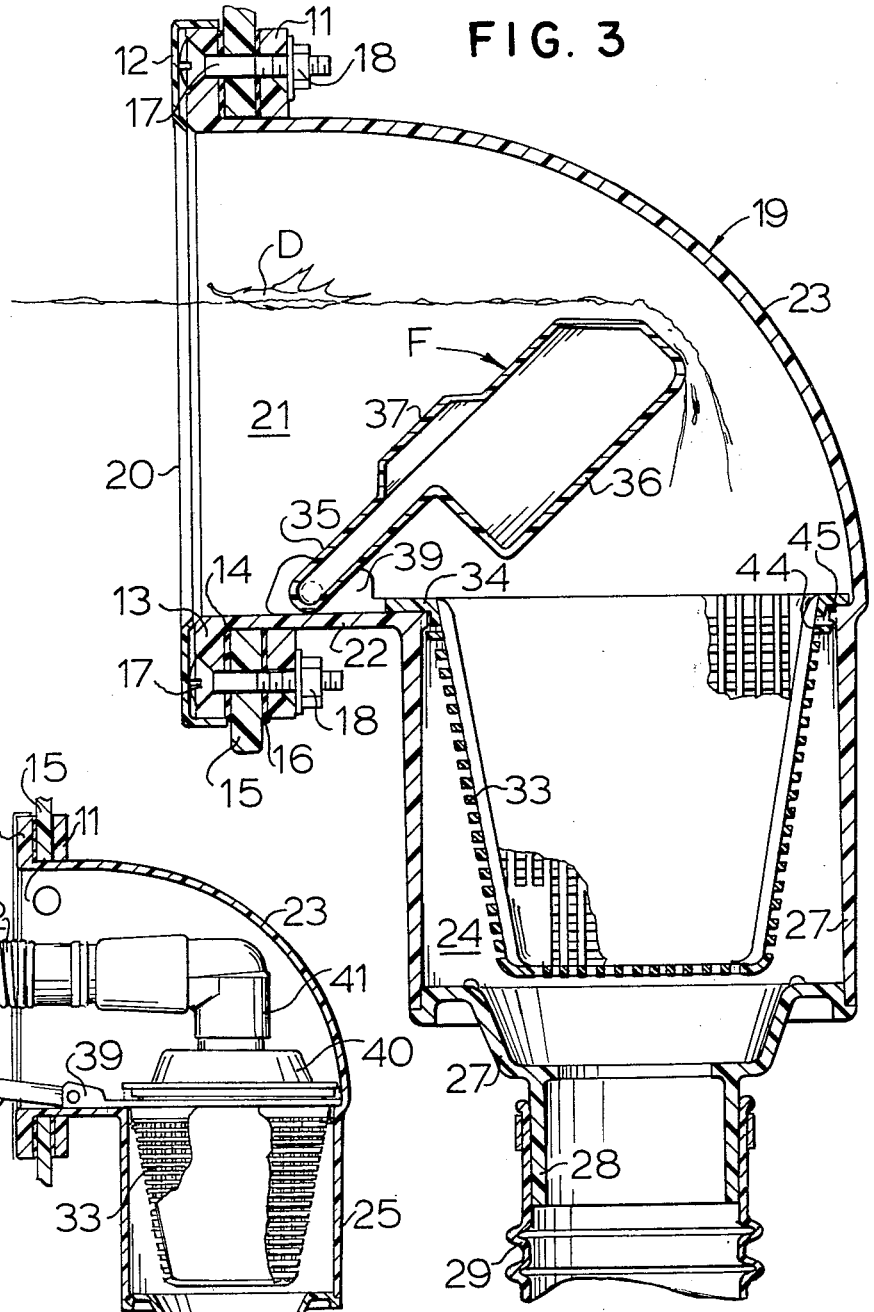
FIG. 3 is a vertical cross-sectional view of the skimmer assembly during operation.

The water entering through the opening 20 and exiting through the drain conduit 19 is strained to remove debris by means of a foraminous basket 33 which preferably takes the configuration of a frusto-pyramid. The open end of the basket 33 has a peripheral flange 34 of sufficient dimensions to overlie the opening 26 of the chamber 24 as best illustrated in FIG. 3 of the drawings. The flange 34 thereby seats the basket 33 in an operative straining position.

At opposite sides of the basket spaced below the flange 34, there is provided a tab or lug 44 which is integral with the basket and made of the same plastic material as the basket so that it is slightly resilient.

Each tab or lug 44 is aligned with a corresponding interference abutment 45 formed on an adjacent wall of the housing 19. As the basket assembly is inserted into the housing 19 the tabs or lugs 44 coact with the adjoining interference abutments 45 to provide a snap-in fit. By virtue of such provision, the detent means formed between the basket and the housing keeps the basket retained in place and the basket will not be inadvertently displaced by flotation or buoyancy forces due to the low density of the basket.

The float F of the present invention preferably takes the form of a blow molded hollow synthetic resin material including a relatively flat forward portion 35 and an enlarged hollow portion 36 which increases the buoyancy of the float. A finger-engaging, raised protuberance 37 is provided on the front face of the float to enable the float to be readily manipulated. The forward end of the float is provided with a pair of pins 38 extending from its front end portion and arranged to be received in apertures suitably provided in ears 39 which constitute vertical extensions of the flange 34 of the basket. Thus, the float assembly is free to pivot about the pins 38 as the water level within the housing increases or decreases.

The float F is in essence a floating weir which passes a thin sheet of water thereover, as illustrated in FIG. 3 of the drawings. Debris D floating on the surface of the water is thus effectively skimmed off the surface and finds its way into the strainer basket 33.

Figure 2:
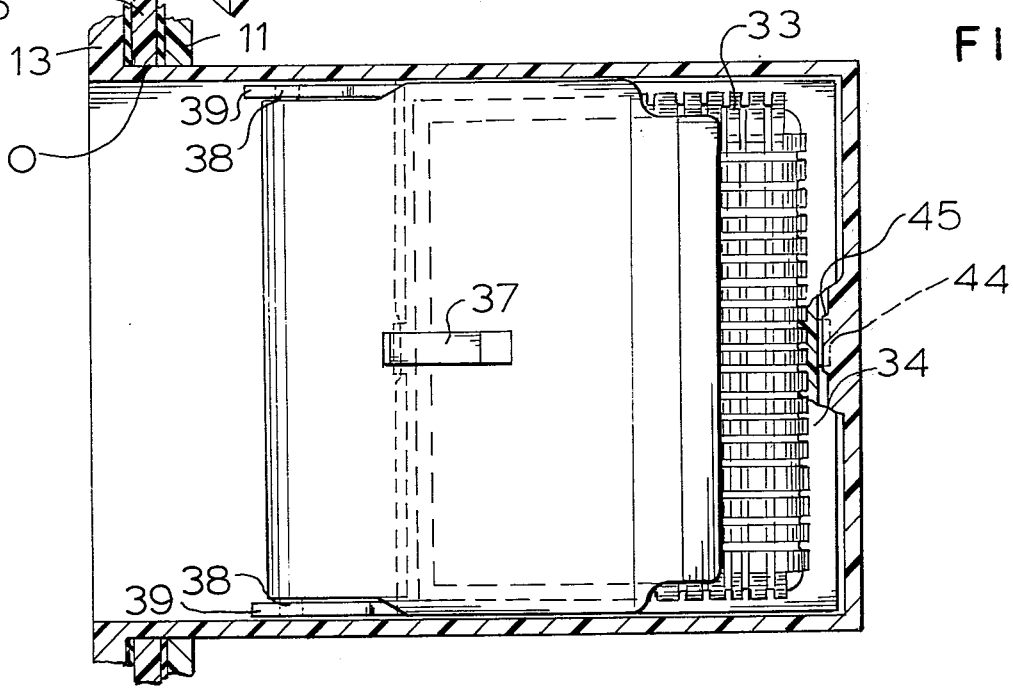
FIG. 2 is a cross-sectional view of the float and basket assembly in operative position within the housing, the parts being partly broken away to illustrate the retaining means.

Removal of the float and strainer basket assembly is accomplished with ease. The user merely places his hand through the opening 20, unseats the peripheral flange 34 from the mouth of the vertical discharge chamber 24, and lifts the strainer basket and float out as a unit. Preferably, the debris collected in the strainer basket is retained by virtue of the float F acting as a cover for the strainer basket (as in FIG. 2).

Figure 4:
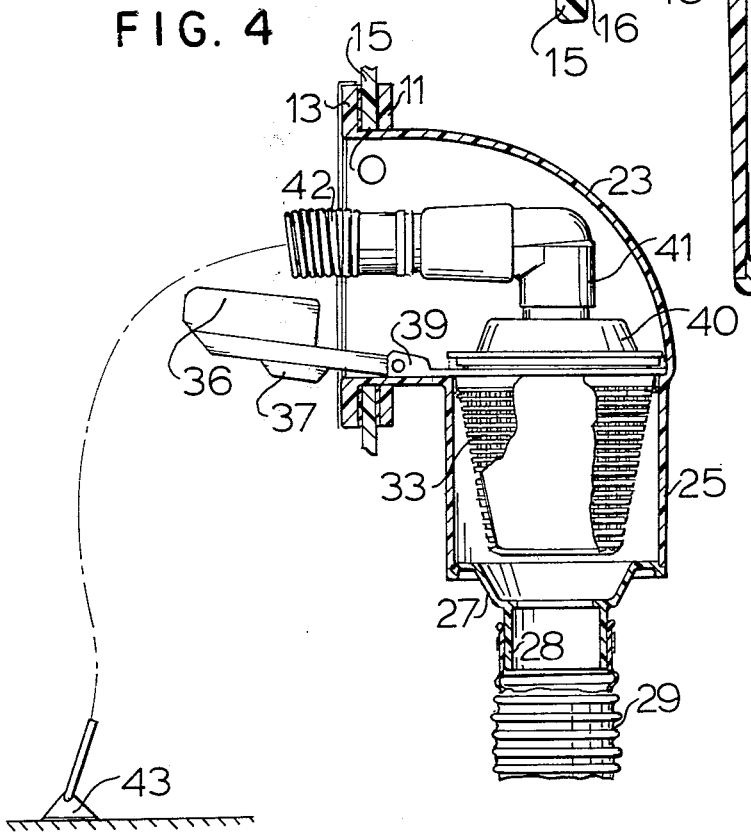
FIG. 4 is a somewhat schematic view illustrating the skimming device employing a vacuum hose attachment.
Figure 5:
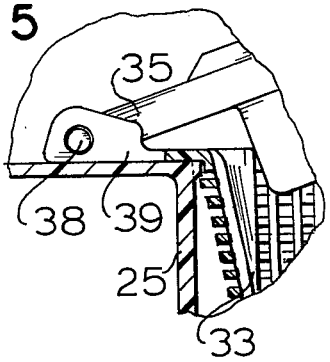
FIG. 5 is a fragmentary enlarged cross-sectional view of the pivot arrangement between the basket and the float.

The skimming assembly of the present invention is also adapted to be used in conjunction with a vacuum system for cleaning the floor of the pool or other enclosure. For this purpose, there is provided a vacuum plate 40 (FIG. 4) to which an elbow 41 is fixedly secured. Connected to the elbow 41 is a flexible hose 42 which is connected to a vacuuming device 43. As illustrated in FIG. 4, it is not necessary to remove the strainer basket 33 in order to use the vacuum plate assembly.

The skimming assembly of the present invention provides a convenient mechanism for incorporation into swimming pools, spas, or other enclosed bodies of water. The housing is of one-piece construction, but it is readily insertable to the inside of any receptacle. The hollow weir structure has a smooth outside surface providing a clean appearance, and is easily cleaned. The weir allows sheeting action to occur, but still allows a passage of large objects by additional pivotal movement. The float-basket assembly is easily removed in one motion through the front opening of the housing for cleaning. The design of the float is such that it traps debris in the basket during removal, thereby providing better cleaning since less debris is lost into the plumbing.

It should be evident that various modifications can be made to the described embodiments without departing from the scope of the present invention.

We claim as our invention:

1. A skimming device arranged to be received within a wall of an enclosure for a body of water comprising:

a housing including a horizontal inlet portion having an opening therein arranged to be positioned in open communication with said body of water, said housing having a downwardly extending vertical discharge chamber with an opening of lesser cross-sectional area than said opening of said horizontal inlet portion, a foraminous strainer basket proportioned to be received through said opening and arranged to be seated in said vertical discharge chamber, and a float pivotally secured to said strainer basket and also proportioned to be received through said opening and being sufficiently large to overlie completely said opening to said vertical discharge chamber, said float being proportioned to be freely insertable in and withdrawable from said horizontal inlet, said strainer basket and said float being removable as a unit from within said housing.

2. A skimming device according to claim 1 in which: said float has a front end portion having pins therein arranged to be received in apertures carried by said basket and thereby pivotally mount said float relative to said basket.

3. A skimming device according to claim 1 in which: said basket is of rectangular frusto-pyramidal configuration.

4. A skimming device according to claim 2 in which: said float has an enlarged hollow portion increasing the buoyancy thereof.

5. A skimming device according to claim 1 in which: said basket has a marginal flange portion arranged to be seated about the perimeter of said vertical discharge chamber to position said basket within said vertical discharge chamber.

6. A skimming device according to claim 5 in which: said marginal flange portion has apertured ears extending therefrom, said float having pins therein arranged to be received in said apertured ears and thereby provide the pivotal connection between said basket and said float.

7. A skimming device according to claim 1 in which: said housing is composed of a synthetic resin of one-piece construction.

8. A skimming device according to claim 1 which includes:

a vacuum plate being proportioned to be received through said opening and being seatable across the entrance to said vertical discharge chamber, said vacuum plate including means for attaching a conduit thereto.

9. For use with a water receptable such as a pool, tub or spa, a skimmer having a housing having a horizontal inlet portion, means forming a downwardly extending vertical discharge chamber having an inlet which is of lesser cross-sectional area than the inlet of the horizontal inlet portion, a strainer basket porportioned to be received through the opening in the horizontal inlet and arranged to be seated in the inlet of said vertical discharge chamber, a float pivotally secured to the basket and proportioned to be received through the opening in the horizontal inlet, the float dimensions being larger than the opening in the vertical discharge chamber, said basket and said float being constructed and arranged to be removable as a unit through the horizontal inlet portion of the housing.

10. The device of claim 9 wherein:

a housing having means forming a vertical pool opening and means forming a vertical extending chamber to which water from said pool opening is diverted, said basket and said housing have detent means therebetween affording a snap-in fit to prevent inadvertent buoyant displacement of said basket.

11. A skimmer as defined in claim 10 wherein said detent means comprises interfitting tabs and abutment means formed between the housing and the basket affording a snap-in fit.

12. A skimming device for use in a wall of an enclosure for a body of liquid comprising:

a one-piece housing insertable into a raw opening in said wall, said housing having two openings, a first opening in a horizontal passage communicating with said body of liquid and a vertical passage communicating with said horizontal passage with a second opening at a bottom end thereof, a strainer basket and weir float assembly removably insertable into said first opening to be received in said housing, said strainer basket and weir float being pivotally joined in assembly such that said basket is received in said vertical passage and said float is received in said horizontal passage.

13. In a skimmer body as defined in claim 12, said weir float assembly forming a close-fitting cover to substantially close said basket in said first position, thereby to trap debris in the basket during removal from the skimmer.

14. The device of claim 12 wherein said housing has a curved rear wall for assisting insertion of said housing into said wall of said enclosure.

15. The device of claim 12 wherein said weir float is sized to abut against an open top wall of said basket defining a maximum pivoting of said float toward said basket.

16. The device of claim 12 including detent means associated with said basket and said housing whereby said basket is restrained within said housing.

17. The device of claim 12 wherein said basket has a marginal flange portion arranged to be seated around the perimeter of said vertical passage to position said basket within said vertical passage.

18. The device of claim 17 wherein said marginal flange portion has apertured ears extending therefrom, said float having pins therein arranged to be received in said apertured ears and thereby provide the pivotal connection between said basket and said float.

19. The device according to claim 12 including a vacuum plate being proportioned to be received through said open end and being seatable across an entrance to said vertical chamber above said basket, said vacuum plate including means for attaching a conduit thereto.

20. For use with a skimmer device having an opening from a horizontal chamber communicating with a body of water being skimmed, and a vertical chamber communicating with said horizontal chamber, a weir float and strainer basket assembly comprising:

a strainer basket sized to be received in said vertical chamber and supported by a means at an open top end and being removable through said opening in said horizontal chamber, a weir float pivotally mounted to said top end of said basket to be removable with said basket, said weir float and basket being sized such that said weir float abuts said top end of said basket when said float pivots toward said basket providing a cover for said basket when said assembly is removed from said skimming device.

21. The device of claim 20 wherein said weir float has manual grasping means provided to assist in the insertion of said assembly with said skimmer.

22. A skimming device for use in a wall of an enclosure for a body of water comprising:

a one piece housing insertable into a raw opening in said wall, said housing having a curved rear wall for assisting insertion and having a horizontal passage communicating at an open end with said body of water and a vertical passage communicating with said horizontal passage, a strainer basket and weir float assembly removably insertable into said open end to be received in said housing, said strainer basket and weir float being pivotally joined such that said basket is received in said vertical passage and said float is received in said horizontal passage, said weir float being sized to abut against an open top wall of said basket defining a maximum pivoting of said float toward said basket, and detent means associated with said basket and said housing whereby said basket is restrained within said housing.

* * * * *